US005553860A

United States Patent [19]

Zelikovich

[11] Patent Number: 5,553,860

[45] Date of Patent: Sep. 10, 1996

[54] SPORTS IMPACT SENSOR APPARATUS FOR PROXIMATE OPERATION

[76] Inventor: Rami Zelikovich, 146 Poskus St., Stoughton, Mass. 02072

[21] Appl. No.: 299,283

[22] Filed: Aug. 31, 1994

[51] Int. Cl.[6] ..... F41J 5/02; A63B 69/34

[52] U.S. Cl. ..... 273/371; 273/57.3; 273/411; 273/455; 482/12; 482/83; 482/84

[58] Field of Search ..... 273/29 R, 31, 273/29 A, 371, 411, 57.3, 440, 445, 454, 455; 482/12, 83, 84

[56] References Cited

U.S. PATENT DOCUMENTS

| | | | |
|---|---|---|---|
| 3,874,664 | 4/1975 | Faurot et al. | 273/29 A |
| 3,897,947 | 8/1975 | Heffley, Jr. | 273/35 B |
| 4,009,883 | 3/1977 | Yellowlees et al. | 273/181 |
| 4,029,315 | 6/1977 | Bon | 273/55 R |
| 4,309,032 | 1/1982 | Facius | 273/29 A |
| 4,676,511 | 6/1987 | Mackie | 273/376 |
| 4,718,669 | 1/1988 | Carlton et al. | 273/29 R |
| 4,799,688 | 1/1989 | Kellman et al. | 273/371 |
| 4,824,107 | 4/1989 | French | 273/1 GC |
| 4,840,377 | 6/1989 | Bowser et al. | 273/31 |
| 4,855,711 | 8/1989 | Harrop et al. | 273/29 R |
| 5,020,806 | 6/1991 | Martin | 273/371 |
| 5,046,729 | 9/1991 | Yancey | 273/26 A |
| 5,059,944 | 10/1991 | Carmona | 273/29 R |
| 5,072,947 | 12/1991 | Blue | 273/371 |
| 5,184,831 | 2/1993 | Garner | 482/84 |

FOREIGN PATENT DOCUMENTS

WO89/05174 6/1989 WIPO .

OTHER PUBLICATIONS

AMP Incorporated Prouduct Description No. 6, "Piezo Film Vibration Sensors: New Techniques for Modal Analysis", Revised May 1993.

AMP Incorporated Application Note 7, "Interfacing Piezo Film to Electronics", Revised Apr. 1993.

Elf Atochem Sensors, Inc. Product Description and Advertisement, "Standard and Custom Piezo Film Components", Published 1992.

AMP Product Data Sheet 11, "Summary of Operating Properties", Revised Mar. 1993.

*Primary Examiner*—Jessica J. Harrison
*Assistant Examiner*—Mark A. Sager
*Attorney, Agent, or Firm*—Lahive & Cockfield

[57] ABSTRACT

A sports impact sensing target reports a sensed impact to a remote location without interference with the operation of like impact sensing targets that are proximately located. The sports impact target reports each sensed impact with a selected modulated signal that can be selected readily to distinguish it from the report signals produced by other proximate impact sensing targets.

4 Claims, 2 Drawing Sheets

SPORTS IMPACT SENSOR APPARATUS FOR PROXIMATE OPERATION

BACKGROUND

This invention relates to sporting and athletic devices for sensing impact on a target and for reporting the sensed impact without interference with impact reports of other proximate targets.

The invention is useful in an impact sensor capable of operation proximate to other like sensors, as on adjacent tennis courts, without operational frequency. The invention is also useful in an impact sensor having two or more zones; for example, different zones in a baseball pitching sensor.

A sports impact sensor typically has an input detector exposed to impact at a target location and spaced from the user, and has an indicator located at the user or a further location. Signals conducted on wires or broadcast through the air communicate impact response signals from the sensor to the indicator.

It is known to use a piezo film to sense impact in sporting and athletic devices as disclosed, for example, in U.S. Pat. No. 4,824,107 of French, the disclosure of which is incorporated herein by this reference. Piezo film is manufactured and marketed, for example, under the trademark Kynar by Elf Atochem Sensors, Inc. in Valley Forge, Pa., USA.

It is an object of this invention to provide an impact sensor for sporting and athletic use proximate to like sensors without operational interference.

Another object of the invention is to provide an impact sensor of the above character suitable for use with a target having two or more zones.

A further object is to provide impact sensor apparatus of the above character suited for relatively low cost manufacture and marketing.

SUMMARY OF THE INVENTION

A sports impact sensor according to the invention transmits impact information from a sensor to an indicator by modulating a carrier signal. The carrier frequency is selected, and can readily be changed, to ensure freedom from interference with different sensors selectively spaced in the same target or in different but proximate targets. One example, provides different sensor elements to sense different zones on a baseball pitching device and modulate different carrier signals to avoid interference between the impact-responsive signals from the different sensors. An alternative practice is to modulate a single carrier signal differently for each sensor element. Another example is to provide different zones on a fencing vest. A further example is to provide different sensors, each on a different target and operating, each with a different user, proximate to other targets, as on adjacent tennis courts or on adjacent archery targets.

The modulated carrier signal according to the invention is broadcast to the indicator by way of a receiver. For example, the carrier signal can be a radio frequency signal or an infrared signal or an optical laser signal. An alternate practice is to communicate the modulated signal from the sensor location to the indicator location on conductors, for example, electrical wires or fiber optic cables. In this instance, the same set of conductors can carry signals from multiple sensors or sensor elements, for example each with a different carrier frequency. One preferred practice suited for remarkably low cost manufacture is a sports impact sensor having a radio frequency transmitter, and operating with an indicator having a radio frequency receiver, and in which both the sensor transmitter and the indicator receiver employ circuitry similar to that found in remotely operated garage door systems, where the user can readily select the frequency to avoid interference with adjacent garage doors or garage doors of neighbors.

These and other objects of the invention will be more apparent from the further description set forth below.

BRIEF DESCRIPTION OF DRAWING

These and other features of the invention will become further apparent from the following detailed description, taken in connection with the accompanying drawings, in which.

DESCRIPTION OF ILLUSTRATED EMBODIMENT

Figure 1:
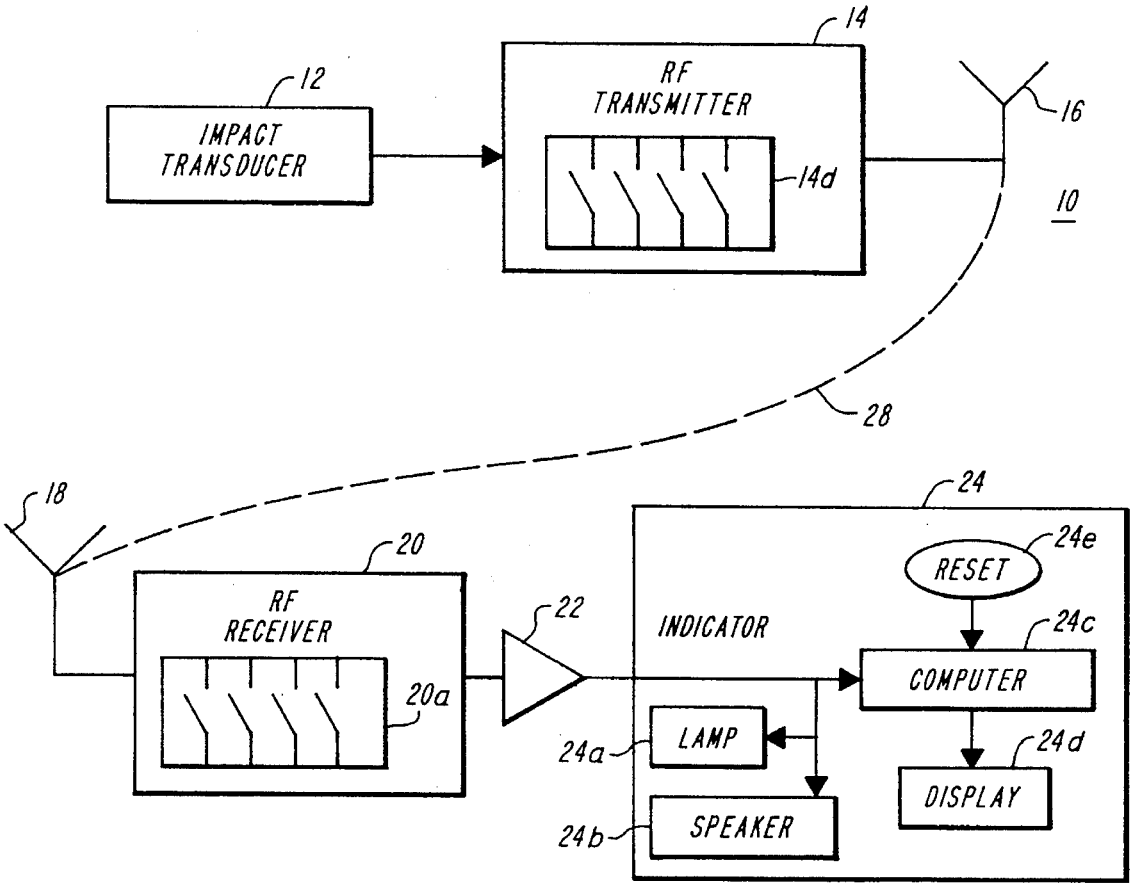
FIG. 1 is a schematic block diagram of a sports impact sensor system according to the invention.

FIG. 1 shows an impact sensing target according to the invention for use, for example, as a tennis target or, alternatively, as an archery target. The illustrated impact sensing target 10 has an input transducer 12 that responds to a physical impact to produce an electrical signal that it applies to a radio frequency transmitter 14 having a carrier selector switch 14*a*. In response to each impact responsive signal it receives from the transducer 12, the RF transmitter 14 broadcasts a report signal from an antenna 16. One form of the report signal is an amplitude modulated radio frequency carrier signal, the frequency of which is selected by way of the carrier selector switch 14*a*. The antenna 18 of a radio frequency receiver 20 intercepts the broadcast signal. The RF receiver has a carrier selector switch 20*a* set to the same carrier frequency as the RF transmitter 14 and hence responds to and demodulates the report signal broadcast from the transmitter 14. The RF receiver applies the received sensor responsive signal to a buffer amplifier 22, the output of which drives an indicator 24. The illustrated indicator has a lamp 24*a*, a loud speaker 24*b* and a counter 24*c* connected with a counter display 24*d*. A reset switch 24*e* is connected to return the counter display to zero.

With further reference to FIG. 1, the impact transducer 12 preferably is a piezo film transducer element of the type marketed under the trade name Kynar as identified above. It is disposed with a surface exposed for impact by a sports implement, such as a tennis ball, a pitched baseball, an archery arrow, or a fencing foil. One preferred form of the RF transmitter 14 with the carrier selector switch 14*a* is a radio frequency transmitter as used in a remote garage door control system. Correspondingly, one preferred form of the illustrated RF receiver 20 with the carrier selector switch 20*a* is a radio frequency receiver with selected carrier frequency as used in a remote control garage door system.

The buffer amplifier 22 is preferably an integrated circuit semiconductor buffer amplifier for isolating the output of the receiver 20 from the elements of the indicator 24 and selected for driving the indicator elements. The amplifier 22 can, in response to an impact-responsive signal output from the receiver 20, turn on the lamp 24*a* for a selected interval and drive the speaker 24*b* to produce a selected audible tone.

The amplifier 22 also applies a pulse or like signal to the counter 24*c* in response to each impact-responsive signal it receives from the receiver 20. In response, the counter 24*c* increments by one integer the count it displays on the counter display 24*d*.

The RF transmitter 14 is representative of a selectable modulator that produces a carrier signal modulated in response to the signal from the input transducer 12. Thus, the modulator unit 14 produces a carrier signal, the frequency of which is selected by way of the carrier selector switch 14*a* and which is modulated in response to each signal impact responsive signal from the transducer 12. The modulator according to the invention can produce a modulated radio frequency signal as discussed above and, alternatively, can produce a modulated infrared signal of the type used in the remote control of household electronic components. A further example is to produce a modulated optical beam, as produced with a laser. The output signal from the modulator unit can be applied either to a broadcast antenna 16 as illustrated, or to a communication cable 28, indicated with broken lines, for communicating the signal to the RF receiver 20. The receiver is illustrative of a selectable demodulator in general, corresponding to the above-described broadcast modulator illustrated as the transmitter 14.

In another practice of the invention, the transmitter 14 modulates a carrier signal in a mode selected with the selector switch 14*a*. In this practice of the invention, the selector switch selects one of several different forms of modulation of a carrier signal; for example, pulse width modulation or other coded modulation.

The selectable demodulator, of which the illustrated RF receiver 20 is a preferred example, is constructed correspondingly similar to the selectable modulator 14, e.g. to receive and to demodulate a modulated radio frequency signal of selected carrier frequency, a modulated infrared signal of selected carrier frequency, or a modulated optical signal of selected frequency. Further, where the modulator 14 applies any of selected different forms of modulation to a carrier, as selected with the selector switch 14*a*, the demodulator 20 is set by way of the selector switch 20*a* to demodulate or otherwise decode that form of modulation.

A tennis target constructed as illustrated in FIG. 1 with a radio frequency transmitter 14 and a radio frequency receiver 20 can operate in one tennis court adjacent another court having an identical tennis target, and with the transmitter/receiver pair of each target set by way of the selector switches 14*a* and 20*a* to different carrier frequencies. Each tennis target will then operate without signal interference with the other. The user of the tennis target of FIG. 1 can readily select the carrier frequency of the transmitter receiver operation by manually or otherwise adjusting the selector switches 14*a* and 20*a* in a manner analogous to the homeowner adjustment of a remotely operated garage door system.

One preferred transmitter selector switch 14*a* and receiver selector switch 20*a* has four stages of switches, as FIG. 1 shows, and select any of sixteen carrier frequencies.

Figure 2:
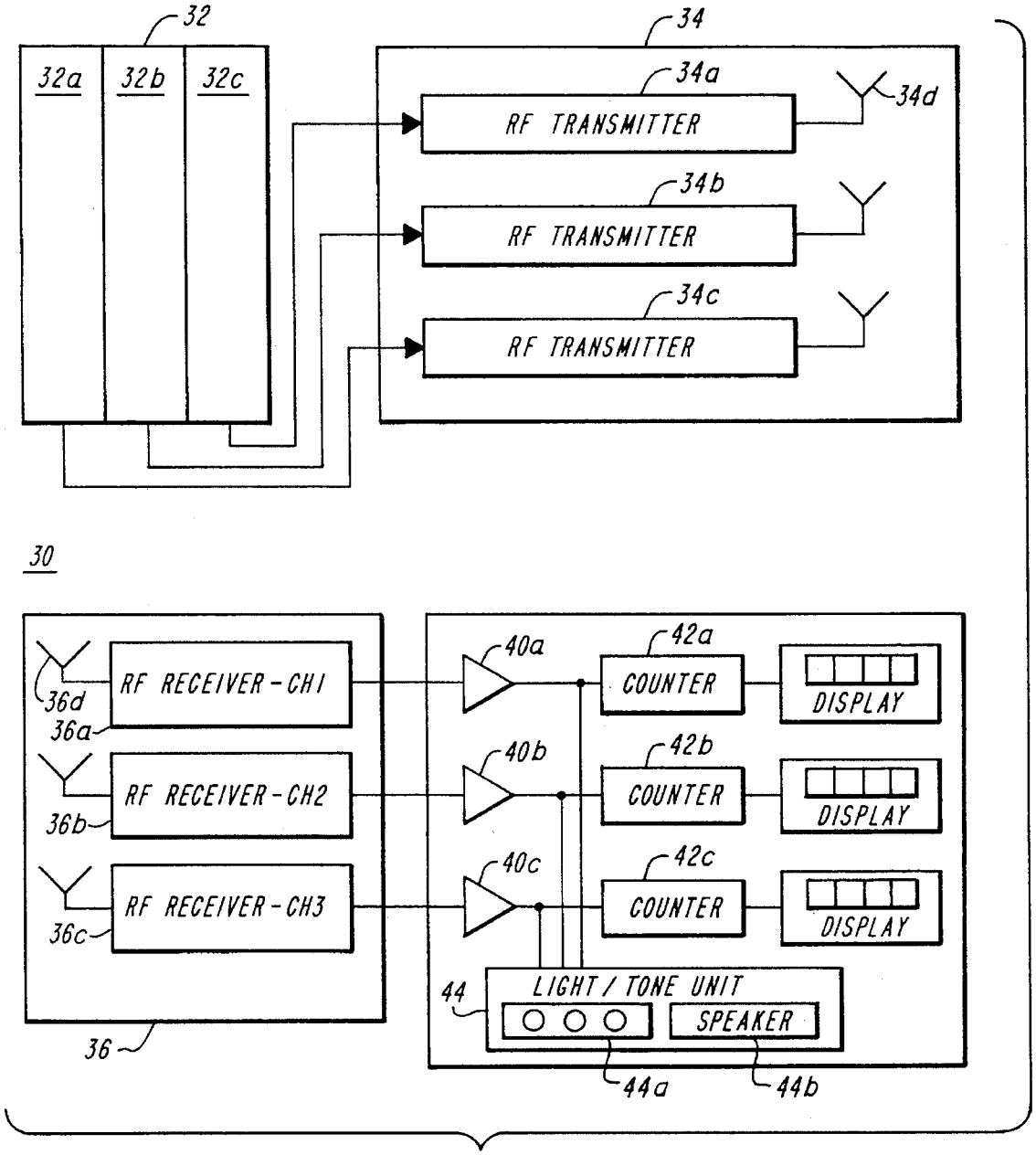
FIG. 2 is a block schematic illustration of a multi-zone sports impact sensor according to further features of the invention.

FIG. 2 shows a multi-zone sports target 30 having a multi-zone impact transducer 32 connected electrically with a modulated broadcast unit 34. The illustrated multi-zone transducer 32 has three input zones 32*a*, 32*b* and 32*c*, each of which preferably is constructed with a Kynar brand piezo film transducer. The illustrated multi-zone transducer 32 can, by way of example, be a baseball pitching target with the illustrated zone 32*b* be deployed to correspond to the center of a strike zone, and the remaining two zones 32*a* and 32*c* deployed to correspond to "inside" and "outside" pitching zones.

The modulated broadcast unit 34 responds to the output signal from each zone section of the transducer 32 to produce a modulated signal that it broadcasts to a demodulation unit 36. The illustrated broadcast unit 34 has three RF transmitters 34*a*, 34*b*, and 34*c*, each of selectable carrier frequency and each corresponding to the RF transmitter 14 with a carrier selector switch 14*a* as described above in FIG. 1. Further, each transmitter 34*a*, 34*b* and 34*c* is set to broadcast with a different carrier frequency.

The illustrated demodulator unit 36 is constructed with three RF receivers 36*a*, 36*b* and 36*c*, each with a selector switch and hence each selectable as to the carrier frequency it demodulates, as described with reference to the receiver 20 of FIG. 1. Each receiver is set to receive and to demodulate a carrier frequency identical to a corresponding transmitter in the broadcast unit 34. Thus, in response to an impact at the zone element 32*c* of the transducer 32, the RF transmitter 34*a* in the broadcast unit produces a modulated carrier signal that is transmitted, suitably by way of an antenna 34*d*, to the demodulator unit 36 where the RF receiver 36*a* is set to respond to the same carrier frequency as is broadcast by the RF transmitter 34*a*. The three transmitters 34*a*, 34*b* and 34*c* of the broadcast unit 34 can share a common antenna 34*d*, with suitable frequency selective couplings, and alternatively can have different antennas, as illustrated. Similarly, the demodulated unit 36 can employ separate antennas 36*d*, each connected separately to one RF receiver 36*a*, 36*b* or 36*c*, and alternatively can have a single antenna coupled through appropriate frequency selective coupling units (not shown) to the three receivers 36*a*, 36*b* and 36*c*.

With further reference to FIG. 2, the illustrated multi-zone sports target 30 has an output unit 38 connected to receive and to respond to signals output from the demodulator unit 36. The illustrated output unit 38 has three buffer amplifiers 40*a*, 40*b* and 40*c*, each connected to the output from one receiver 36*a*, 36*b* and 36*c*, respectively, and each of which in turn drives a separate counter 42*a*, 42*b* and 42*c*, respectively, as shown. The buffer amplifiers 40*a*, 40*b* and 40*c* also drive a light/tone unit 44 that has a selected lamp and loud speaker configuration for reporting each sensed impact on the multiple zone transducer 32. In one practice, the light/tone unit has three separate light elements 44*a*, each corresponding to one zone section of the transducer. Thus, an impact on the strike zone element 32*b* of the transducer 32 will result in one corresponding lamp element 44*a* being illuminated to indicate to the user that the pitch impacted on the strike zone element 32*b*. Further, the light/tone unit 44 preferably has tone generator and loud speaker to produce different tones corresponding to each of the three zone elements of the transducer 32.

Although illustrated as communicating by way of broadcast signals between the antennas 34*d* and 36*d*, the multiple zone sports target 30 can operate with a communication cable (not shown) and corresponding to the communication cable 28 of FIG. 1. The wireless construction and operation with antennas, as shown, is deemed preferable.

It will be apparent that the modulator broadcast unit 34 can employ various constructions as discussed above with reference to the RF transmitter 14 of FIG. 1. Further, the broadcast unit can employ a single RF transmitter that broadcasts with three different carrier signals, depending on which of the transducer zone elements, to which it is connected, receives an impact. Correspondingly, the demodulator unit 36 can employ different constructions as discussed above with reference to the RF receiver 20 of FIG. 1 and can employ a single RF receiver that responds to different carrier frequencies, or other modulated broadcast signals, depending on which carrier frequency or other signal format is broadcast from the broadcast unit 34. The illustrated construction with separate RF transmitters 34*a*, 34*b* and 34*c* and separate RF receivers 36*a*, 36*b* and 36*c* is deemed capable of ready implementation, with commercially available circuits as marketed for remote control garage door equipment.

The foregoing description is intended to be illustrative, rather than exhaustive of the invention. Persons of ordinary skill in the art of sports targets may make certain additions to, deletions from, or changes in the embodiments described in this disclosure without departing from the spirit or the scope of the invention as set forth in the appended claims.

Having described the invention, what is new and secured by Letters Patent is:

1. Sports target apparatus for operation without signal interference with other proximately located such apparatus, said apparatus comprising a) a first piezo film impact transducer having a surface exposed for impact by a sports implement and producing an impact responsive electrical signal in response to impact, b) an impact reporting transmitter connected to respond to an impact responsive signal from said impact transducer for broadcasting a selected modulated carrier signal, said transmitter including first selection means for broadcasting only one of a first set of different modulated carrier signals, c) an impact reporting receiver arranged for receiving the selected modulated carrier signal and for producing in response thereto an impact responsive output signal, said impact reporting receiver including second selection means for receiving only one of said first set of different modulated carrier signals, and d) an output unit for responding to the import responsive output signal from said receiver to produce a selected perceptible report of impact on the transducer, so that first and second proximately located target apparatus can each operate with different modulated carrier signals and thereby avoid signal interference with one another.

2. Sports target apparatus according to claim 1 further a) at least a second impact transducer input disposed at a different location from said first impact transducer; for exposure to differently located impacts, b) at least a second transmitter, connected to respond to an impact responsive signal from only said second transducer, c) at least a second receiver arranged to receive the modulated carrier signal of only the said second transmitter, and d) in which said output unit responds to each said receiver and produces a report in response to said first receiver at least in part different from the report produced in response to said second receiver.

3. Sports target apparatus according to claim 1 in which said transmitter includes means for broadcasting each modulated carrier signal in said first set thereof with a carrier frequency different from the carrier frequency of other said signals in said first set thereof.

4. Sports target apparatus according to claim 1 in which each of said first selection means and of said second selection means includes a set of manually operable selection switches.

* * * * *